US007142187B1

(12) United States Patent
Kim et al.

(10) Patent No.: US 7,142,187 B1
(45) Date of Patent: Nov. 28, 2006

(54) LIQUID CRYSTAL DISPLAY DRIVING SCALER CAPABLE OF REDUCING ELECTROMAGNETIC INTERFERENCE

(75) Inventors: Ho-young Kim, Seoul (KR); Yong-sub Kim, Seoul (KR)

(73) Assignee: Samsung Electronics, Co., Ltd. (KR)

( * ) Notice: Subject to any disclaimer, the term of this patent is extended or adjusted under 35 U.S.C. 154(b) by 465 days.

(21) Appl. No.: 10/702,839

(22) Filed: Nov. 6, 2003

(30) Foreign Application Priority Data

Dec. 4, 2002 (KR) ..... 10-2002-0076698

(51) Int. Cl.
*G09G 3/36* (2006.01)

(52) U.S. Cl. ..... 345/100; 345/87; 345/89

(58) Field of Classification Search ..... 345/204, 345/3, 507, 1, 132, 212, 196, 213, 207, 87, 345/89, 100, 585; 348/572
See application file for complete search history.

(56) References Cited

U.S. PATENT DOCUMENTS

| | | | | |
|---|---|---|---|---|
| 5,448,300 | A * | 9/1995 | Yamada et al. | 348/571 |
| 5,757,338 | A * | 5/1998 | Bassetti et al. | 345/3.2 |
| 6,057,809 | A * | 5/2000 | Singhal et al. | 345/3.3 |
| 6,091,304 | A | 7/2000 | Harrer | 331/10 |
| 6,175,387 | B1 * | 1/2001 | Han | 348/565 |
| 6,473,131 | B1 * | 10/2002 | Neugebauer et al. | 348/572 |
| 6,618,089 | B1 * | 9/2003 | Tamayama | 348/333.13 |
| 6,731,293 | B1 | 5/2004 | Tojima et al. | 345/537 |
| 6,768,498 | B1 * | 7/2004 | Kim | 345/698 |
| 6,791,623 | B1 * | 9/2004 | Masuda et al. | 348/563 |
| 2002/0033899 | A1 * | 3/2002 | Oguma | 348/565 |
| 2002/0171639 | A1 * | 11/2002 | Ben-David | 345/207 |
| 2003/0030654 | A1 * | 2/2003 | Sagano et al. | 345/660 |
| 2004/0233181 | A1 * | 11/2004 | Kobayashi | 345/204 |

FOREIGN PATENT DOCUMENTS

| | | |
|---|---|---|
| JP | 2002-297101 | * 11/2002 |
| KR | 2002-0004823 | 1/2002 |
| KR | 2002-0049446 | 6/2002 |

* cited by examiner

*Primary Examiner*—Bipin Shalwala
*Assistant Examiner*—Prabodh Dharia
(74) *Attorney, Agent, or Firm*—Mills & Onello LLP

(57) ABSTRACT

An LCD driving scaler capable of reducing electromagnetic interference employs a spread spectrum phase locked loop (PLL) in which a multi-phase voltage controlled oscillator oscillates and outputs a scaler pixel clock signal and a plurality of oscillation signals of different phases. A spread spectrum processor counts clock periods of a reference pixel clock signal when a horizontal synchronization signal having an adjusted frame rate is activated, and sequentially outputs the plurality of oscillation signals in response to a decoding signal. The plurality of oscillation signals are output to a main divider, which generates the main divider signal by dividing the frequencies of the plurality of oscillation signals. A main divider signal is input into a phase frequency detector, which detects a phase difference between the predivider signal and the main divider signal and outputs the phase difference signal so that the frequency of the scaler pixel clock signal repeatedly varies.

16 Claims, 7 Drawing Sheets

LIQUID CRYSTAL DISPLAY DRIVING SCALER CAPABLE OF REDUCING ELECTROMAGNETIC INTERFERENCE

This application claims the priority of Korean Patent Application No. 2002-76698, filed Dec. 4, 2002, in the Korean Intellectual Property Office, the disclosure of which is incorporated herein in its entirety by reference.

BACKGROUND OF THE INVENTION

1. Field of the Invention

The present invention relates to a liquid crystal display (LCD), and more particularly, to an LCD driving scaler which is capable of reducing electromagnetic interference.

2. Description of the Related Art

High-speed personal computers (PCs), which operate at high clock frequencies, are susceptible to a serious problem of electromagnetic interference (EMI). Display devices, such as large-sized monitors or LCDs, also have the same problem as the high-speed PCs because of a high pixel clock frequency. For this reason, a variety of research have been carried out with respect to methods for reducing EMI.

In order to reduce EMI, a metal shielding technique can be applied. Alternatively, a passive device, such as a multi-layered printed circuit board, a choke coil, or a bead, can be used. However, EMI is reduced through repetitive trials and failures, and thus increases in the material and manufacturing costs and the time taken to develop a product are inevitable.

In the meantime, growing attention has been paid to one EMI reduction method: a spread spectrum modulation method. According to the spread spectrum modulation method, the frequency of an input clock is modulated so that the clock frequency varies periodically.

FIGS. 1A and 1B are graphs showing frequency spectra respectively prior to and following frequency modulation performed for the purpose of reducing EMI.

Referring to FIGS. 1A and 1B, as a result of frequency modulation, the frequency spectrum of a clock is spread out over a wide range of frequencies, and, consequently, the maximum amplitude of the clock decreases. In general, a spread spectrum clock generator (SSCG), which is a frequency modulator capable of varying an input clock periodically, is used for spread spectrum modulation.

There are two different types of spread spectrum modulation techniques. One is a center spreading technique in which the frequency of a clock signal is modulated so that the frequency of the clock signal periodically varies about a center frequency in upward and downward directions by the same amount, and the other is a down spreading technique in which the frequency of a clock signal is modulated based on a lower frequency than a center frequency so that the frequency of the clock signal can be prevented from exceeding the center frequency.

FIG. 2 is a diagram illustrating a center spreading technique by which a triangular modulation profile is provided through frequency modulation. There are various modulation profiles provided by spread spectrum modulation techniques, such as, a triangular modulation profile, a sinusoidal modulation profile, and a so-called "Hershey-Kiss" modulation profile. Hereinafter, the modulation rate and the modulation period will be described in the following paragraphs with reference to FIG. 2, taking the triangular modulation profile as an example.

In FIG. 2, the modulation rate represents the width of the variation of the frequency of a modulated output signal obtained by modulating the frequency of an input clock signal in a spread spectrum modulation method, and the modulation period represents the period of the variation of the frequency of the modulated output signal. The modulation frequency is a reciprocal number of the modulation period.

An LCD monitor having SXGA resolution or higher also requires the above-described spread spectrum modulation technique using a spread spectrum clock generator because an LCD monitor having a high resolution uses a high-frequency system clock of about 100 MHz, which means that a user of the LCD monitor is susceptible to exposure to strong electromagnetic waves at such a high frequency level.

In general, spread spectrum modulation techniques, in which the frequency spectrum of an input system clock input into a scaler is spread by using a spread spectrum clock generator, have been applied to LCDs. Hereinafter, among the conventional spread spectrum modulation methods using a spread spectrum clock generator, two spread spectrum modulation methods using a spread spectrum clock generator before and after using a phase locked loop (PLL) will be briefly described.

In a conventional spread spectrum modulation method in which a spread spectrum clock generator is used prior to the PLL, the frequency of a clock signal obtained by performing spread spectrum on an input high-frequency system clock is divided before being processed by the PLL, and then a scaler pixel clock signal is generated in the PLL.

Here, the spread spectrum clock generator receives a system clock from a crystal oscillator, receives information necessary to control a modulation rate via input pins, and performs spread spectrum on the system clock according to a modulation frequency fixed at about 30–50 kHz.

On the other hand, in another conventional spread spectrum modulation method in which a spread spectrum clock generator is used following the PLL, the frequency of a high-frequency system clock is divided, and the result of the division is input into the PLL. Then, a scaler pixel clock signal is generated by spread-spectrum-modulating a signal output from the PLL.

Pixel data output in synchronization with the scaler pixel clock are provided to an LCD source driver via a gamma correction circuit so that a screen can be displayed on an LCD panel.

However, since the above-mentioned conventional spread spectrum modulation methods use a PLL in a spread spectrum clock generator and a PLL included in a scaler, a mismatch in frequencies between the two PLLs is more likely to occur. In other words, due to a mismatch in frequencies between a scaler output clock and a pixel driving clock, the scaler output clock fails to drive pixels. This problem can be solved by increasing the frequency division rate and thus reducing the phase difference between the two PLLs, but a high frequency division rate causes another problem as described below.

Assume that the modulation rate of a spread-spectrum-modulated clock signal is A and the frequency division rate is as high as 1000. Then, as a result of frequency-dividing the spread-spectrum-modulated clock before processing it in a PLL, the modulation rate for the clock signal to be input into the PLL is decreased to be as small as A/1000, which indicates a weak spread spectrum effect.

Spread spectrum clock generators used in the prior art have been manufactured by many companies, including Pulse Core Corp., ICS Corp., and Cypress Semiconductor Corp. In such spread spectrum clock generators, a modulation frequency is determined in advance by an input clock frequency, and only the modulation rate can be adjusted within several percent of the input clock frequency by an IC pin setting. Accordingly, it is impossible to set the modulation frequency to be the same as or a predetermined number of times higher than the frequency of an input horizontal synchronization signal HSYNC of a video signal. Therefore, it is impossible in this configuration to match the frequency of the input horizontal synchronization signal HSYNC with the modulation frequency. In addition, since pixel data are transmitted to vertical lines of an LCD panel at different moments in time, horizontal lines of the LCD panel have corresponding different brightnesses.

In the conventional approaches, since a spread spectrum clock generator is provided external to a scaler, it is impossible to perform a spread spectrum modulation technique to a clock signal within the scaler. In order to solve this problem, a spread spectrum clock generator can be provided immediately following a PLL included in a scaler so that the frequency spectrum of a clock processed in the PLL can be spread. However, in such a case, problems as a frequency mismatch between two PLLs, a weak spread spectrum effect, and a difference in brightness between lines of an LCD panel still remain unsolved.

In addition, in the conventional approaches, since a spread spectrum clock generator is provided external to a scaler, the scaler requires additional input/output pins for the spread spectrum clock generator, which results in an increase in the chip size.

SUMMARY OF THE INVENTION

The present invention provides a scaler for driving a liquid crystal display (LCD), which is capable of reducing a chip size, providing a superior spread spectrum effect, stabilizing brightness between lines of the LCD, and reducing EMI, by generating a scaler pixel clock having a spectrum spread out by a phase locked loop (PLL) therein.

According to an embodiment of the present invention, there is provided an LCD driving scaler including a register controller, an analog-to-digital converter, a frame rate controller, a pixel data scaler, a multiplexer, a predivider, and a spread spectrum PLL.

The register controller stores predetermined control information in a register and performs general control operations.

The analog-to-digital converter generates digital pixel data, synchronized with an input pixel clock signal, by converting analog pixel data input therein, and outputs a horizontal synchronization signal, a vertical synchronization signal, and the input pixel clock signal generated in response to the horizontal synchronization signal, and the vertical synchronization signal.

The frame rate controller adjusts the frame rate to be compatible with a liquid crystal display (LCD) panel and outputs the digital pixel data, the horizontal synchronization signal, and the vertical synchronization signal.

The pixel data scaler generates scaler output pixel data in response to the digital pixel data, the horizontal synchronization signal, and the vertical synchronization signal, the output pixel data having an adjusted frame rate, by scaling the digital pixel data to be synchronized with a scaler pixel clock signal, which is compatible with the LCD panel, and outputs the horizontal synchronization signal and the vertical synchronization signal having an adjusted frame rate.

The multiplexer selectively outputs a system clock signal and the input pixel clock signal.

The predivider divides the frequency of an output signal of the multiplexer and thus outputs a predivider signal.

The spread spectrum PLL generates the scaler pixel clock signal corresponding to a signal representing a phase difference between the predivider signal and a main divider signal and the horizontal synchronization signal having an adjusted frame rate, and a plurality of oscillation signals of different phases and generates the main divider signal by dividing the frequencies of the oscillation signals, which are sequentially selected in response to a decoding signal.

Preferably, the spread spectrum PLL includes a phase frequency detector, a charge pump, a loop filter, a multi-phase voltage controlled oscillator, a spread spectrum processor, and a main divider.

The phase frequency detector detects a phase difference between the predivider signal and the main divider signal and outputs the phase difference signal.

The charge pump supplies current in response to the phase difference signal.

The loop filter outputs voltage in response to the current supplied from the charge pump.

The multi-phase voltage controlled oscillator oscillates in response to the voltage output from the loop filter and outputs the scaler pixel clock signal and the plurality of oscillation signals of different phases.

The spread spectrum processor counts clock periods of a reference pixel clock signal when the horizontal synchronization signal having an adjusted frame rate is activated, and sequentially outputs the plurality of oscillation signals in response to the decoding signal incrementing or decrementing every few cycles of the reference pixel clock signal.

The main divider generates the main divider signal by dividing the frequencies of the plurality of oscillation signals.

Preferably, the spread spectrum processor includes a counter, a decoder, and a plurality of switches.

The counter is reset when the horizontal synchronization signal having an adjusted frame rate is activated, counts the number of times the reference pixel clock signal reaches a second logic level, and outputs the decoding signal incrementing or decrementing every predetermined number of times the reference pixel clock signal reaches the second logic level;

The decoder outputs a plurality of switching signals sequentially inverting their phases from a first logic state to a second logic state in response to the decoding signal.

The plurality of switches are turned on in response to their corresponding switching signals so that one of the oscillation signals corresponding to a switch that is turned on is selectively output.

Preferably, the decoding signal varies depending on the predetermined control information, and the modulation rate and the modulation frequency in a spread spectrum modulation process are determined in accordance with the variation of the decoding signal.

Preferably, the horizontal synchronization signal having an adjusted frame rate is input into the counter so that it can be adjusted to be compatible with the modulation frequency in a spread spectrum modulation process.

Preferably, a spread spectrum effect is obtained when the system clock signal is converted into the predivider signal through frequency modulation.

Preferably, a spread spectrum effect is obtained when the input pixel clock signal is converted into the predivider signal through frequency modulation.

BRIEF DESCRIPTION OF THE DRAWINGS

The above features and advantages of the present invention will become more apparent by describing in detail exemplary embodiments thereof with reference to the attached drawings in which.

DETAILED DESCRIPTION OF PREFERRED EMBODIMENTS

Figure 1A:
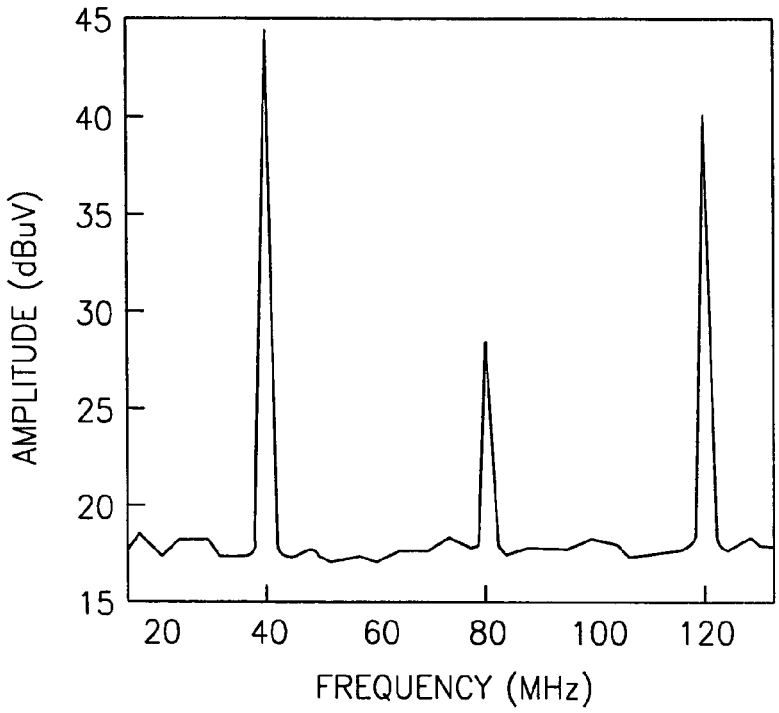
FIG. 1A (PRIOR ART)
FIGS. 1A and 1B are graphs showing frequency spectra before and after frequency modulation is performed in order to reduce electromagnetic interference (EMI)
Figure 1B:
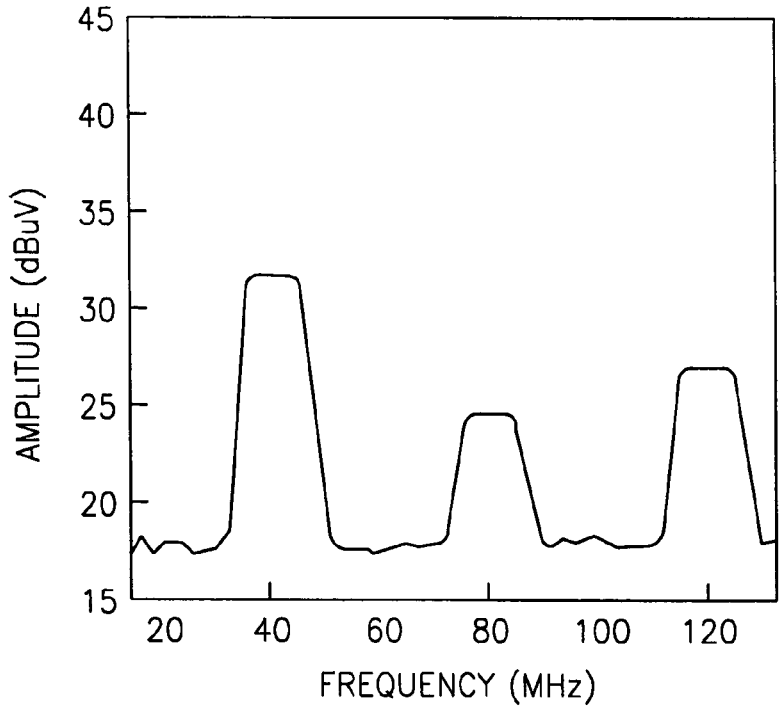
FIG. 1B (PRIOR ART)
Figure 2:
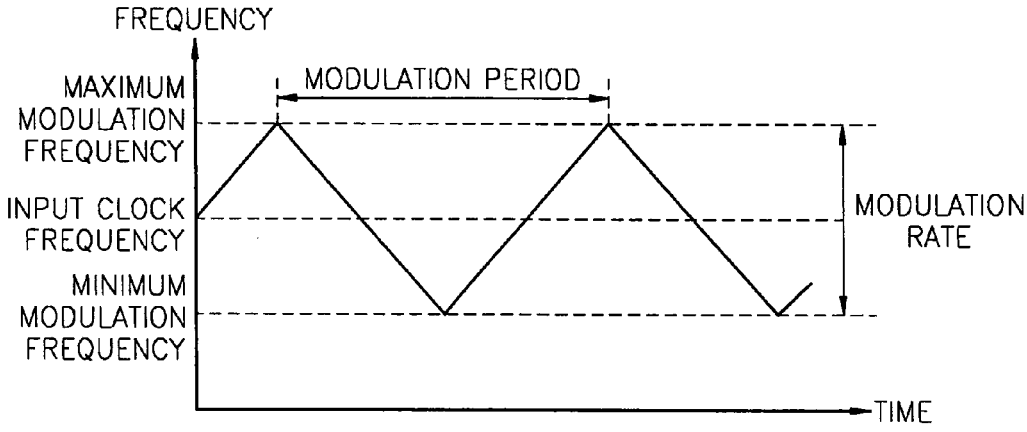
FIG. 2 (PRIOR ART)
FIG. 2 is a diagram illustrating frequency modulation having a triangular modulation profile according to a center spreading method, which is an example of a spread spectrum modulation method.

Hereinafter, the present invention will be described in greater detail with reference to the accompanying drawings in which preferred embodiments of the present invention are shown. In the drawings, the same reference numerals represent the same elements.

Figure 3:
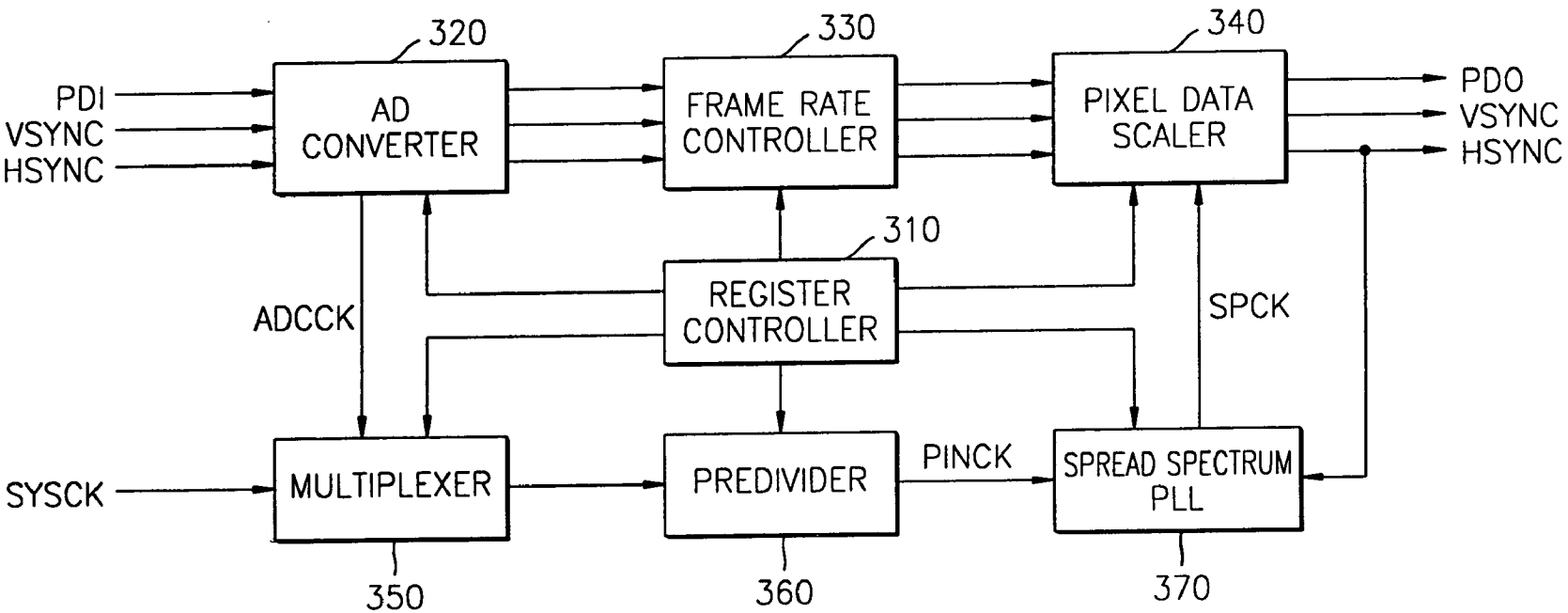
FIG. 3 is a block diagram of a scaler for driving a liquid crystal display (LCD) according to a preferred embodiment of the present invention.

FIG. 3 is a block diagram of a scaler for driving a liquid crystal display (LCD) according to a preferred embodiment of the present invention. Referring to FIG. 3, the scaler includes a register controller 310, an analog-to-digital (AD) converter 320, a frame rate controller 330, a pixel data scaler 340, a multiplexer 350, a predivider 360, and a spread spectrum phase locked loop (PLL) 370.

The register controller 310 stores predetermined control information in a register and performs general control operations. Here, the predetermined control information stored in the register includes the division rate of the predivider 360 and of a main divider 376 (see FIG. 4) of the spread spectrum PLL 370, modulation frequency and modulation frequency of spread spectrum, information necessary to control the frame rate to correspond with an associated LCD panel, and other information necessary for the register controller 310 to perform the general control operations.

The AD converter 320 converts analog pixel data PDI input thereto into digital pixel data synchronized with an input pixel clock signal ADCCK and outputs a horizontal synchronization signal HSYNC, a vertical synchronization signal VSYNC, and the input pixel clock signal ADCCK generated in response to the horizontal synchronization signal HSYNC and the vertical synchronization signal VSYNC. In other words, the AD converter 320 converts the input analog pixel data PDI into digital pixel data and outputs the digital pixel data in synchronization with the input pixel clock signal ADCCK. Here, the input pixel clock signal ADCCK is a signal having the same frequency as the transmission frequency of the input pixel data PDI and is generated by a PLL included in the AD converter 320 in response to the horizontal synchronization signal HSYNC and the vertical synchronization signal VSYNC input into the AD converter 320.

The frame rate controller 330 outputs the digital pixel data, the horizontal synchronization signal HSYNC, and the vertical synchronization signal VSYNC by adjusting the frame rate to correspond to a LCD panel. As for the frame rate adjustment, some frames are deleted from or added to the input pixel data PDI so as to cause the input pixel data PDI to have a signal system compatible with a signal system of the LCD panel if the input pixel data PDI have a different signal system (e.g., XGA) from a signal system (e.g., SXGA) of pixel data PDO output to the LCD panel.

In response to the digital pixel data having an adjusted frame rate, the horizontal synchronization signal HSYNC, and the vertical synchronization signal VSYNC, the pixel data scaler 340 outputs the pixel data PDO obtained by scaling the digital pixel data to be synchronized with a scaler pixel clock signal SPCK corresponding to the LCD panel and outputs the horizontal and vertical synchronization signals HSYNC and VSYNC each having an adjusted frame rate. In the process of scaling the digital pixel data, new data are generated by interpolating pixels into the digital pixel data so that the newly generated data can have as many pixels as the pixel data PDO output to the LCD panel when the digital pixel data (e.g., 1280*1024 SXGA) have a smaller number of pixels than the pixel data PDO (e.g., 1400*1050 SXGA) output to the LCD panel. If the pixel data PDO output to the LCD panel have a smaller number of pixels than the digital pixel data, some pixels of the digital pixel data may also be deleted in the process of scaling the digital pixel data.

The pixel data PDO output from the pixel data scaler 340 in synchronization with the scaler pixel clock SPCK are provided to an LCD source driver via a gamma correction circuit so that a picture image can be displayed on the LCD panel.

The multiplexer 350 selectively outputs a system clock signal SYSCK and the input pixel clock signal ADCCK.

The predivider 360 divides the frequency of an output signal of the multiplexer 350 and thus outputs a predivider signal PINCK.

Figure 4:
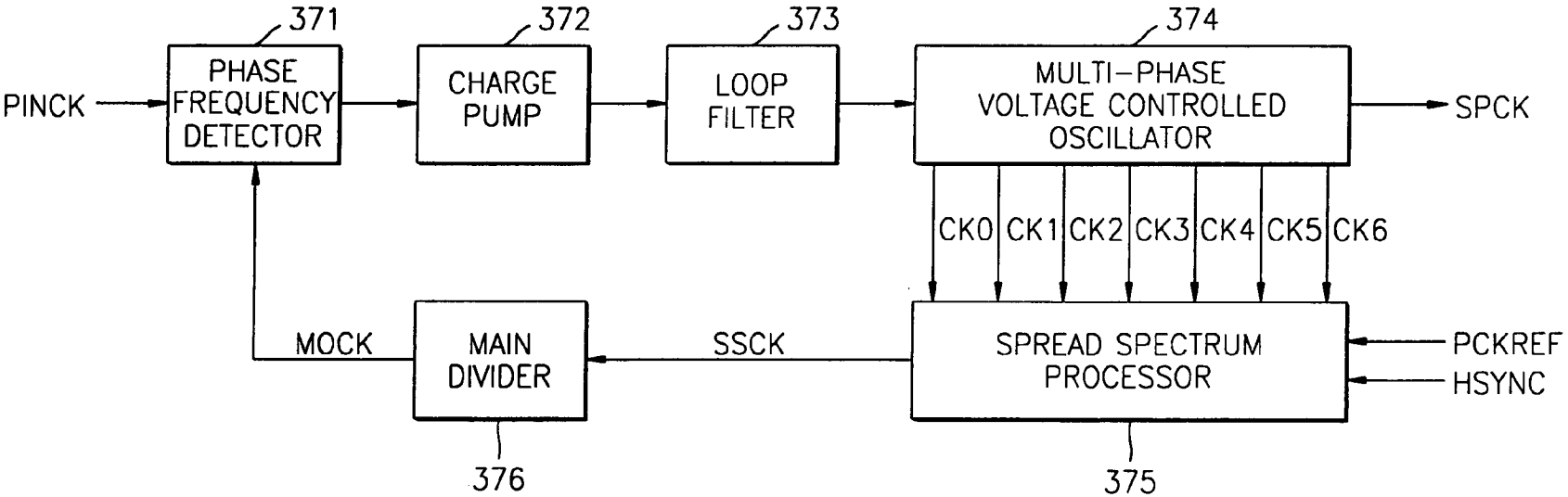
FIG. 4 is a block diagram of a spread spectrum phase locked loop (PLL) of an LCD driving scaler according to a preferred embodiment of the present invention.

The spread spectrum PLL 370 generates the scaler pixel clock signal SPCK corresponding to a signal representing a phase difference between the predivider signal PINCK and a main divider signal MOCK and the horizontal synchronization signal HSYNC having an adjusted frame rate, and a plurality of oscillation signals CK0 through CK6 having different phases and sequentially divides the frequency of each of the oscillation signals CK0 through CK6 in response to a decoding signal, thus generating the main divider signal MOCK (discussed below with reference to FIG. 4).

The LCD driving scaler according to the present invention can operate in two different modes, i.e., a frame rate control (FRC) mode and a frame sync mode.

In the FRC mode, the multiplexer 350 outputs the system clock signal SYSCK, in which case the signal system (e.g., XGA) of the input pixel data PDI is adjusted to be the same as the signal system (e.g., SXGA) of the pixel data PDO output to the LCD panel and the frame rate of signals output to the LCD panel is synchronized with the frame rate of input signals.

FIG. 4 is a block diagram of the spread spectrum PLL 370. Referring to FIG. 4, the spread spectrum PLL 370 includes a phase frequency detector 371, a charge pump 372, a loop filter 373, a multi-phase voltage controlled oscillator 374, a spread spectrum processor 375, and the main divider 376.

The phase frequency detector 371 detects the phase difference between the predivider signal PINCK and the main divider signal MOCK and outputs the phase difference signal as a result of the detection.

The charge pump 372 supplies current to the loop filter 373 in response to the phase difference signal.

The loop filter 373 outputs a voltage at a level corresponding to the amount of current supplied from the charge pump 372.

The multi-phase voltage controlled oscillator 374 oscillates in response to the voltage output from the loop filter 373 and outputs the scaler pixel clock signal SPCK and the oscillation signals CK0 through CK6 having different phases. Here, the number of oscillation signals may vary depending on the chip design made by a user.

When the horizontal synchronization signal HSYNC having an adjusted frame rate is activated, the spread spectrum processor 375 counts clock periods of a reference pixel clock signal PCKREF and sequentially outputs the oscillation signals CK0 through CK6 in response to the decoding signal, which increases by 1 every few cycles of the reference pixel clock signal.

The main divider 376 generates the main divider signal MOCK by dividing the frequency of a selected oscillation signal SSCK. Here, the spread spectrum performed by the LCD driving scaler according to the present invention is rarely affected by the division rates of the predivider 360 and the main divider 376, and thus it is possible to freely adjust the division rates of the predivider 360 and the main divider 376.

Figure 5:
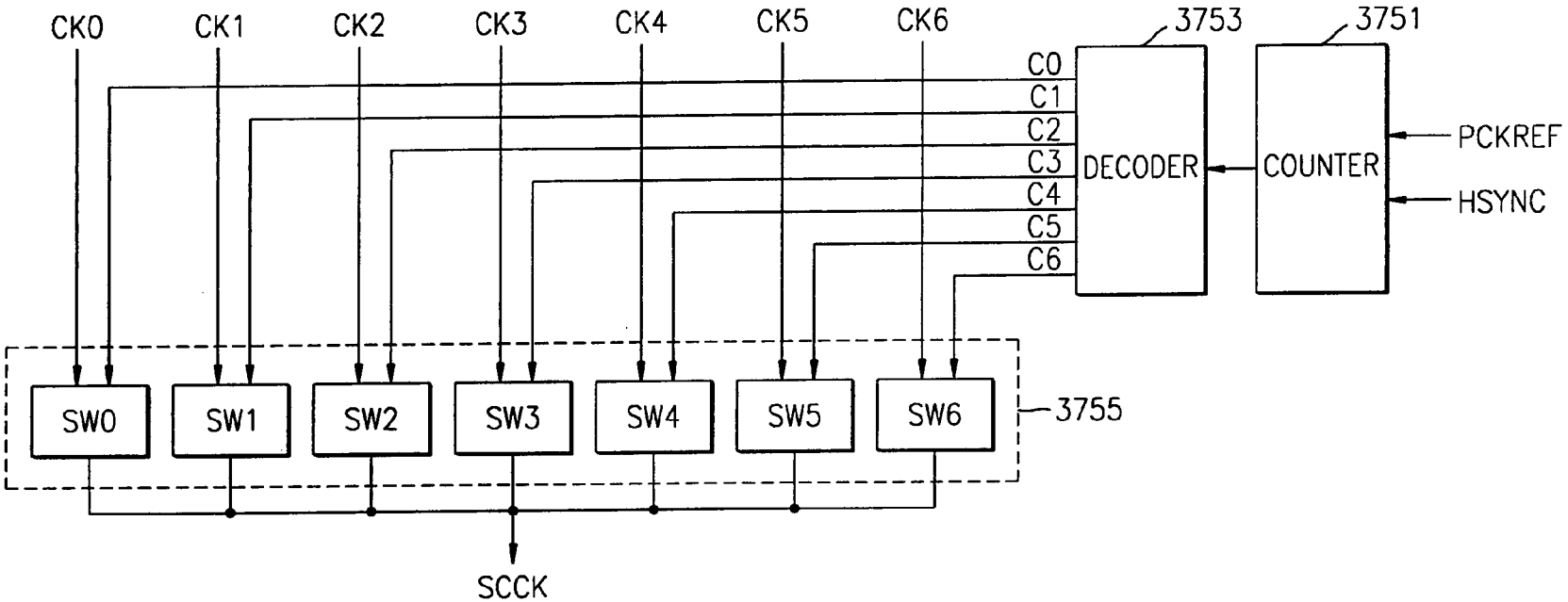
FIG. 5 is a block diagram a spread spectrum processor included in a spread spectrum PLL of an LCD driving scaler according to a preferred embodiment of the present invention.

FIG. 5 is a block diagram of the spread spectrum processor 375 included in the spread spectrum PLL 370. Referring to FIG. 5, the spread spectrum processor 375 includes a counter 3751, a decoder 3753, and a plurality of switches 3755.

When the horizontal synchronization signal HSYNC having an adjusted frame rate is activated, i.e., when the state of the horizontal synchronization signal HSYNC is converted from a first logic state (e.g., a logic low state) to a second logic state (e.g., a logic high state), the counter 3751 is reset, counts the number of times a reference pixel clock signal PCKREF reaches a second logic level, i.e., a logic high level, and outputs the decoding signal, which increases by 1 every few times when the reference pixel clock signal PCKREF reaches the logic high level.

The decoder 3753 outputs a plurality of switching signals C0 through C6 sequentially inverting their phases from a first logic state to a second logic state in response to the decoding signal. Here, the number of switching signals C0 through C6 is the same as the number of oscillation signals CK0 through CK6 having different phases, and the switching signals C0 through C6 are sequentially output in response to the decoding signal. In addition, the first logic state and the second logic state represent a logic low state and a logic high state, respectively.

The switches 3755 are turned on in response to their corresponding switching signals. When one of the switches 3755 is turned on, an oscillation signal corresponding to the switch that is turned on is selectively output. Here, the number of switches 3755 is the same as the number of oscillation signals CK0 through CK6 having different phases, and the oscillation signals CK0 through CK6 are selectively output in response to their corresponding switching signals.

Accordingly, the decoding signal varies depending on the predetermined control information, and the modulation rate and the modulation frequency in a spread spectrum modulation process are determined in accordance with the variation of the decoding signal. In other words, the decoding signal increases by 1 every few cycles when the scaler pixel clock signal SPCK reaches a second logic level, i.e., a logic high level. The incremental rate of the decoding signal determines the modulation rate and the modulation frequency in a spread spectrum modulation process.

In the frame rate control (FRC) mode, the frequency spectrum of the system clock signal SYSCK is spread out when the predivider signal PINCK is obtained by modulating the frequency of the system clock signal SYSCK using the predivider 360 and the main divider 376. Supposing that division rates P and M of the predivider 360 and the main divider 376, respectively, are high enough to precisely obtain the scaler pixel clock signal SPCK required by the LCD panel and are, for example, 1000, the following equation is satisfied.

$$P = \frac{f(SYSCK)}{f(PINCK)} = 1000 \qquad (1)$$

$$M = \frac{f(SYSCK)}{f(PINCK)}$$

In Equation (1), f(x) represents the frequency of a signal x. In other words, when the system clock signal SYSCK has a frequency of 30 MHz, the predivider signal PINCK has a frequency of 30 kHz, and the scaler pixel clock signal SPCK, which is the result of spreading the frequency spectrum of the system clock signal SYSCK through frequency modulation, is generated via the multi-phase voltage controlled oscillator 374 and the spread spectrum processor 375.

In the frame sync mode, the frequency spectrum of the input pixel clock signal ADCCK is spread out when the predivider signal PINCK is obtained, by modulating the frequency of the input pixel clock signal ADCCK. For example, the division rate P of the predivider 360 is set by synchronizing the predivider signal PINCK with the main divider signal MOCK and counting clocks of the input pixel clock signal ADCCK so that the frequency of the predivider signal PINCK can be equal to the frequency of the horizontal synchronization signal HSYNC output to the LCD panel. In addition, the frequency of the scaler pixel clock signal SPCK, which satisfies Equation (2) below, is determined by multiplying the frequency of the predivider signal PINCK or the frequency of the horizontal synchronization signal HSYNC output to the LCD panel with the number of pixels included in one horizontal line of the LCD panel.

$$P = \frac{HIP}{V} \qquad (2)$$

$$M = HOP$$

In Equation (2), HIP represents the number of pixels included in a horizontal line of the LCD panel and corresponds to the input pixel data PDI, V represents the number of vertical lines of the LCD panel, and HOP represents the number of horizontal lines of the LCD panel.

Therefore, the spread spectrum processor 375 of the spread spectrum PLL 370 receives the horizontal synchronization signal HSYNC output to the LCD panel from the pixel data scaler 340, and thus it is possible to adjust the modulation frequency in a spread spectrum modulation process to be the same as the frequency of the horizontal synchronization signal HSYNC output to the LCD panel.

Accordingly, it is possible to prevent brightness from instantaneously varying between horizontal lines of an LCD panel and to obtain a stable display screen without any distortions. In addition, it is possible to provide a high-performance spread spectrum effect by solving problems with the prior art, such as a frequency mismatch between two PLLs and an inferior spread spectrum effect caused by a high division rate.

The operation of the LCD driving scaler according to the present invention will be described in greater detail in the following paragraphs.

Figure 6A:
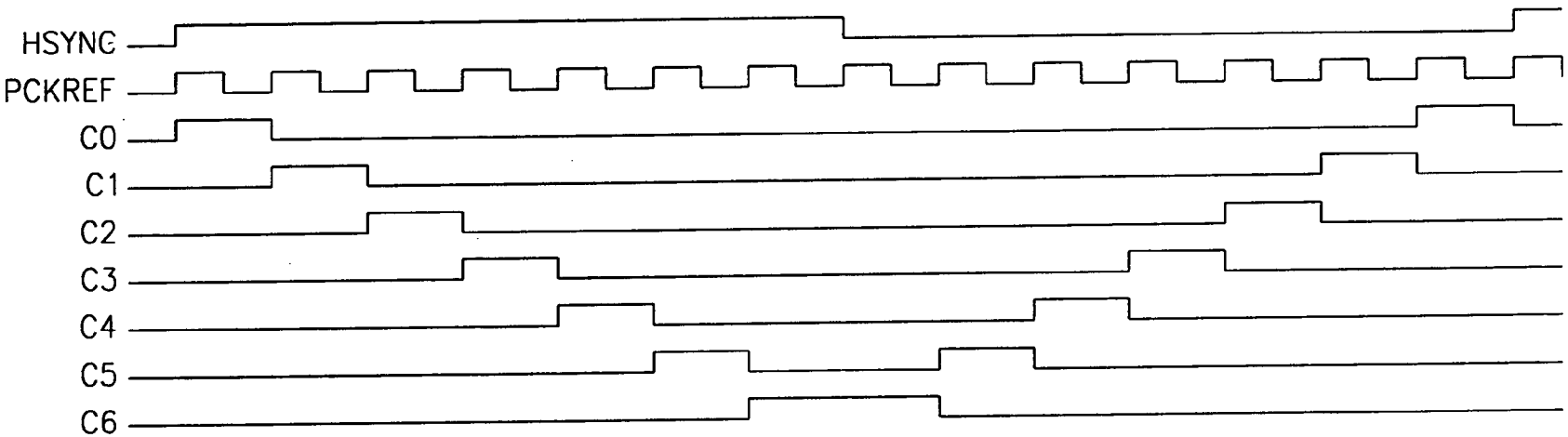
FIGS. 6A and 6B are diagrams illustrating the operation of a spread spectrum processor included in a spread spectrum PLL of an LCD driving scaler according to a preferred embodiment of the present invention, when the modulation rate is low.
Figure 6B:
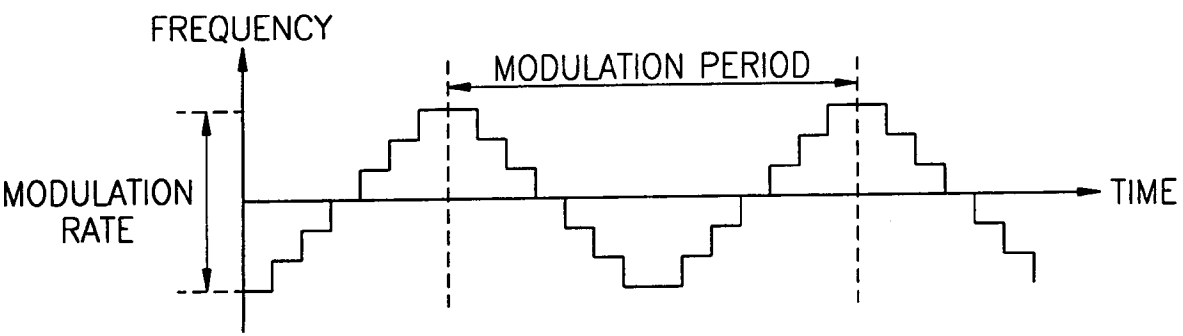

FIGS. 6A and 6B are diagrams illustrating the operation of the spread spectrum processor 375 included in the spread spectrum PLL 370 of the LCD driving scaler according to the present invention, when the modulation rate is low.

Figure 7A:
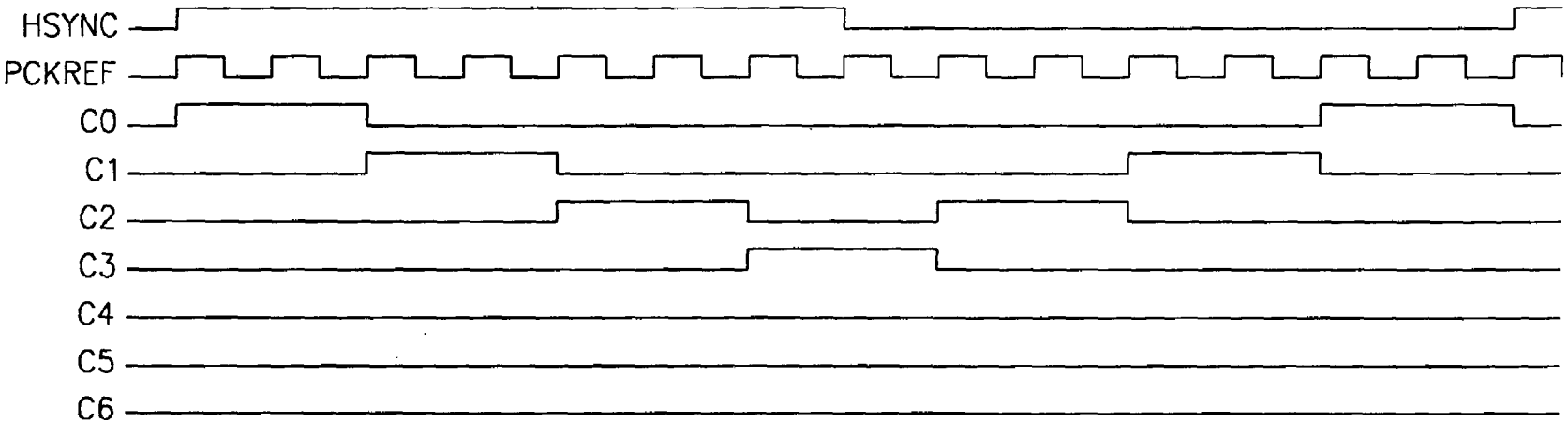
FIGS. 7A and 7B are diagrams illustrating the operation of a spread spectrum processor included in a spread spectrum PLL of an LCD driving scaler according to a preferred embodiment of the present invention, when the modulation rate is high.
Figure 7B:
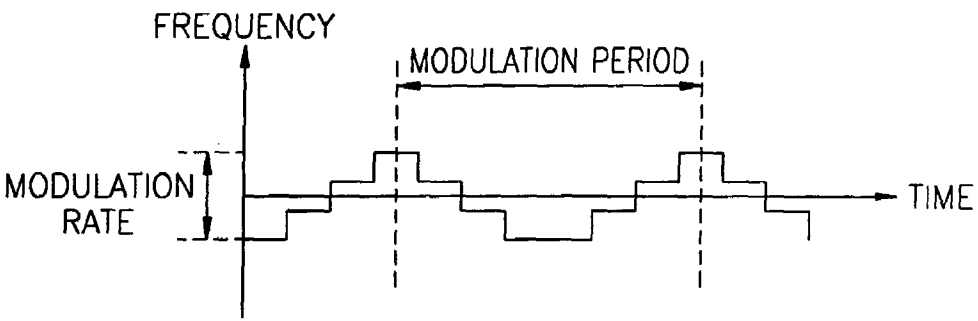

FIGS. 7A and 7B are diagrams illustrating the operation of the spread spectrum processor 375 included in the spread spectrum PLL 370 of the LCD driving scaler according to the present invention, when the modulation rate is high.

Referring to FIGS. 6A and 7A, the reference pixel clock signal PCKREF is synchronized with the horizontal synchronization signal HSYNC output to the LCD panel and continues to oscillate in accordance with cycles of the horizontal synchronization signal HSYNC. The counter 3751 counts the number of times the reference pixel clock signal PCKREF reaches a second logic level, i.e., a logic high level in one period of the horizontal synchronization signal HSYNC. As shown in FIGS. 6A and 7A, let us assume that the reference pixel clock signal PCKREF reaches a second logic level, i.e., a logic high level, fourteen times in one period of the horizontal synchronization signal HSYNC.

When the horizontal synchronization signal HSYNC is activated, i.e., when the state of the horizontal synchronization signal HSYNC is converted from a first logic state, i.e., a logic low state, to a second logic state, i.e., a logic high state, the counter 3751 is reset to "0" and resumes counting the number of times the reference pixel clock signal PCKREF reaches a second logic level, i.e., a logic high level, and outputs the decoding signal, which increases by 1 every predetermined number of times when the reference pixel clock signal PCKREF reaches the second logic level. Here, the predetermined number is stored in the register controller 310 as predetermined control information and is set to "1" and "2" in FIGS. 6A and 7A, respectively.

Accordingly, the decoder 3753 outputs a plurality of switching signals C0 through C6 sequentially inverting their phases from a first logic state, i.e., a logic low state, to a second logic state, i.e., a logic high state, in response to the decoding signal.

Thereafter, the switches 3755 are turned on in response to their corresponding switching signals. When one of the switches 3755 is turned on, an oscillation signal corresponding to the switch that is turned on is selectively output to the main divider 376. As described above, the oscillation signals CK0 through CK6 have different phases.

The oscillation signals CK0 through CK6 having different phases are output to the main divider 376 and are divided by M in the main divider 376. As a result of the division, the main divider signal MOCK is obtained. Then, the main divider signal MOCK is input into the phase frequency detector 371. In accordance with the oscillation signals CK0 through CK6 of different phases repeatedly input into the phase frequency detector 371, the phase frequency detector 371 repeatedly outputs signals having different phases, which are to be compared with the predivider signal PINCK. Then, the frequency of the scaler pixel clock signal SPCK repeatedly varies, and this spread spectrum effect contributes to the reduction of EMI.

In other words, as shown in FIG. 6A, when the switching signal C0 reaches a second logic level, i.e., a logic high level, the switch SW0 is turned on, and thus the oscillation signal CK0 corresponding to the switch SW0 is output to the main divider 376. In the same manner, when the switching signals C1 through C6 sequentially reach a second logic level, i.e., a logic high level, their corresponding switches SW1 through SW6 are sequentially turned on, and accordingly, the oscillation signal CK1 through CK6 are sequentially output to the main divider 376.

In FIG. 7A, the oscillation signals CK0 through CK3 corresponding to the switching signals C0 through C3, respectively, are sequentially output to the main divider 376.

Referring to FIG. 6B, the scaler pixel clock signal SPCK, which is spread-spectrum-modulated as shown in FIG. 6A, has a triangular spectrum profile in which the frequency of the scaler pixel clock signal SPCK varies with seven different phases within one modulation period. Here, the modulation period is the same as the period of the horizontal synchronization signal HSYNC having an adjusted frame rate.

Referring to FIG. 7B, the scaler pixel clock signal SPCK, which is spread-spectrum-modulated as shown in FIG. 7A, has a triangular spectrum profile in which the scaler pixel clock signal SPCK varies with four different phases within one modulation period. Here, the modulation period is the same as the period of the horizontal synchronization signal HSYNC having an adjusted frame rate.

As described above, in the LCD driving scaler according to the present invention, the multi-phase voltage controlled oscillator 374 in the spread spectrum PLL 377 oscillates in response to the output voltage of the loop filter 373 and outputs the scaler pixel clock signal SPCK and the oscillation signals CK0 through CK6 having different phases. Accordingly, the spread spectrum processor 375 counts the number of times the reference pixel clock signal SPCK reaches a predetermined logic level when the horizontal synchronization signal HSYNC having an adjusted frame rate is activated. Then, in response to the decoding signal increasing every predetermined number of times the reference pixel clock signal reaches the predetermined logic level, the spread spectrum processor 375 sequentially outputs the oscillation signals CK0 through CK6. The oscillation signals CK0 through CK6 having different phases are output to the main divider 37 and are divided by M. As a result of the division, the main divider signal MOCK is obtained. Thereafter, the main divider signal MOCK is input into the phase frequency detector 371. In accordance with the oscillation signals CK0 through CK6 of different phases repeatedly input into the phase frequency detector 371, the phase frequency detector 371 repeatedly outputs signals having different phases, which are to be compared with the predivider signal PINCK. Then, the frequency of the scaler pixel clock signal SPCK repeatedly varies, and this spread spectrum effect contributes to the reduction of EMI.

Again, as described above, according to the present invention, it is possible to perform spread spectrum modulation in a scaler by replacing a conventional PLL in the scaler with a PLL that employs a multi-phase voltage controlled oscillator, and the PLL using a multi-phase voltage controlled oscillator can freely adjust the modulation rate and the modulation frequency through the control of a register, rather than though an IC pin setting. In addition, in a frame sync mode, the input pixel clock ADCCK in the scaler can also be spread-spectrum-modulated.

Among the output signals of the scaler, the horizontal synchronization signal HSYNC is fed back to a spread spectrum PLL and is used to perform spread spectrum modulation. Therefore, it is easy to manipulate the modulation frequency to be the same as the frequency of the horizontal synchronization signal HSYNC, and thus it is possible to obtain a stable display screen on an LCD panel without abrupt brightness changes between horizontal lines or other distortions.

Since the LCD driving scaler according to the present invention uses a single PLL, it addresses the shortcomings of the conventional approaches, namely, a frequency mismatch between two PLLs and a weak spread spectrum effect caused by a high division rate. Thus a high-performance spread spectrum effect can be provided.

Furthermore, since the spread spectrum modulation is performed in the scaler, there is no need to install a spread spectrum clock generator and no requirement for additional input/output pins for interfacing with the scaler, and thus the chip size can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An LCD driving scaler comprising:

a register controller storing control information in a register;

an analog-to-digital converter generating digital pixel data synchronized with an input pixel clock signal by converting analog pixel data input therein, and outputting a horizontal synchronization signal, a vertical synchronization signal, and the input pixel clock signal generated in response to the horizontal synchronization signal, and the vertical synchronization signal;

a frame rate controller adjusting the frame rate to be compatible with a liquid crystal display (LCD) panel and outputting the digital pixel data, the horizontal synchronization signal, and the vertical synchronization signal;

a pixel data scaler generating scaler output pixel data in response to the digital pixel data, the horizontal synchronization signal, and the vertical synchronization signal, the output pixel data having an adjusted frame rate by scaling the digital pixel data to be synchronized with a scaler pixel clock signal, which is compatible with the LCD panel, and outputting the horizontal synchronization signal and the vertical synchronization signal having the adjusted frame rate;

a selector selectively outputting a system clock signal and the input pixel clock signal;

a predivider dividing the frequency of an output signal of the selector and outputting a predivider signal; and a spread spectrum PLL generating the scaler pixel clock signal corresponding to a signal representing a phase difference between the predivider signal and a main divider signal, the horizontal synchronization signal having an adjusted frame rate, and a plurality of oscillation signals of different phases and generating the main divider signal by dividing the frequencies of the oscillation signals, which are sequentially selected in response to a decoding signal.

2. The LCD driving scaler of claim 1, wherein the spread spectrum PLL comprises:

a phase frequency detector detecting a phase difference between the predivider signal and the main divider signal and outputting the phase difference signal;

a charge pump supplying current in response to the phase difference signal;

a loop filter outputting a voltage level in response to the current supplied from the charge pump;

a multi-phase voltage controlled oscillator oscillating in response to the voltage level output from the loop filter and outputting the scaler pixel clock signal and the plurality of oscillation signals of different phases;

a spread spectrum processor counting clock periods of a reference pixel clock signal when the horizontal synchronization signal having an adjusted frame rate is activated, and sequentially outputting the plurality of oscillation signals in response to the decoding signal incrementing or decrementing in value in response to variations of the reference pixel clock signal; and a main divider generating the main divider signal by dividing the frequencies of the plurality of oscillation signals.

3. The LCD driving scaler of claim 2, wherein the spread spectrum processor comprises:

a counter being reset when the horizontal synchronization signal having an adjusted frame rate is activated, counting the number of times the reference pixel clock signal reaches a second logic level, and outputting the decoding signal that increments or decrements every predetermined number of times the reference pixel clock signal reaches the second logic level;

a decoder outputting a plurality of switching signals sequentially inverting their phases from a first logic state to a second logic state in response to the decoding signal; and a plurality of switches being activated in response to their corresponding switching signals so that one of the oscillation signals corresponding to a switch that is turned on is selectively output.

4. The LCD driving scaler of claim 1, wherein the decoding signal varies depending on the control information, and the modulation rate and the modulation frequency in a spread spectrum modulation process are determined in accordance with the variation of the decoding signal.

5. The LCD driving scaler of claim 1, wherein the horizontal synchronization signal having an adjusted frame rate is input into the counter so that it can be adjusted to be compatible with the modulation frequency in a spread spectrum modulation process.

6. The LCD driving scaler of claim 1, wherein a spread spectrum effect is obtained when the system clock signal is converted into the predivider signal through frequency modulation.

7. The LCD driving scaler of claim 1, wherein a spread spectrum effect is obtained when the input pixel clock signal is converted into the predivider signal through frequency modulation.

8. An LCD driving scaler comprising:

a register controller storing control information in a register;

an analog-to-digital converter generating digital pixel data synchronized with an input pixel clock signal by converting analog pixel data input therein, and outputting a horizontal synchronization signal, a vertical synchronization signal, and the input pixel clock signal generated in response to the horizontal synchronization signal, and the vertical synchronization signal;

a frame rate controller adjusting the frame rate to be compatible with a liquid crystal display (LCD) panel and outputting the digital pixel data, the horizontal synchronization signal, and the vertical synchronization signal;

a pixel data scaler generating scaler output pixel data in response to the digital pixel data, the horizontal synchronization signal, and the vertical synchronization signal, the output pixel data having an adjusted frame rate by scaling the digital pixel data to be synchronized with a scaler pixel clock signal, which is compatible with the LCD panel, and outputting the horizontal synchronization signal and the vertical synchronization signal having the adjusted frame rate;

a selector selectively outputting a system clock signal and the input pixel clock signal;

a predivider dividing the frequency of an output signal of the selector and outputting a predivider signal; and a spread spectrum PLL generating the scaler pixel clock signal corresponding to a signal representing a phase difference between the predivider signal and a main divider signal, the horizontal synchronization signal having an adjusted frame rate, and a plurality of oscillation signals of different phases and generating the main divider signal by dividing the frequencies of the oscillation signals, which are sequentially selected in response to a decoding signal;

wherein the spread spectrum PLL comprises:

a phase frequency detector detecting a phase difference between the predivider signal and the main divider signal and outputting the phase difference signal;

a charge pump supplying current in response to the phase difference signal;

a loop filter outputting a voltage level in response to the current supplied from the charge pump;

a multi-phase voltage controlled oscillator oscillating in response to the voltage level output from the loop filter and outputting the scaler pixel clock signal and the plurality of oscillation signals of different phases;

a spread spectrum processor counting clock periods of a reference pixel clock signal when the horizontal synchronization signal having an adjusted frame rate is activated, and sequentially outputting the plurality of oscillation signals in response to the decoding signal incrementing or decrementing in value in response to variations of the reference pixel clock signal; and a main divider generating the main divider signal by dividing the frequencies of the plurality of oscillation signals.

9. The LCD driving scaler of claim 8, wherein the spread spectrum processor comprises:

a counter being reset when the horizontal synchronization signal having an adjusted frame rate is activated, counting the number of times the reference pixel clock signal reaches a second logic level, and outputting the decoding signal that increments or decrements every predetermined number of times the reference pixel clock signal reaches the second logic level;

a decoder outputting a plurality of switching signals sequentially inverting their phases from a first logic state to a second logic state in response to the decoding signal; and a plurality of switches being activated in response to their corresponding switching signals so that one of the oscillation signals corresponding to a switch that is turned on is selectively output.

10. An LCD driving scaler comprising:

a register controller storing control information in a register;

an analog-to-digital converter generating digital pixel data synchronized with an input pixel clock signal by converting analog pixel data input therein, and outputting a horizontal synchronization signal, a vertical synchronization signal, and the input pixel clock signal generated in response to the horizontal synchronization signal, and the vertical synchronization signal;

a frame rate controller adjusting the frame rate to be compatible with a liquid crystal display (LCD) panel and outputting the digital pixel data, the horizontal synchronization signal, and the vertical synchronization signal;

a pixel data scaler generating scaler output pixel data in response to the digital pixel data, the horizontal synchronization signal, and the vertical synchronization signal, the output pixel data having an adjusted frame rate by scaling the digital pixel data to be synchronized with a scaler pixel clock signal, which is compatible with the LCD panel, and outputting the horizontal synchronization signal and the vertical synchronization signal having the adjusted frame rate;

a selector selectively outputting a system clock signal and the input pixel clock signal;

a predivider dividing the frequency of an output signal of the selector and outputting a predivider signal; and a spread spectrum PLL generating the scaler pixel clock signal corresponding to a signal representing a phase difference between the predivider signal and a main divider signal, the horizontal synchronization signal having an adjusted frame rate, and a plurality of oscillation signals of different phases and generating the main divider signal by dividing the frequencies of the oscillation signals, which are sequentially selected in response to a decoding signal;

wherein the spread spectrum PLL comprises:

a phase frequency detector detecting a phase difference between the predivider signal and the main divider signal and outputting the phase difference signal;

a charge pump supplying current in response to the phase difference signal;

a loop filter outputting a voltage level in response to the current supplied from the charge pump;

a multi-phase voltage controlled oscillator oscillating in response to the voltage level output from the loop filter and outputting the scaler pixel clock signal and the plurality of oscillation signals of different phases.

11. The LCD driving scaler of claim 10, wherein the spread spectrum PLL further comprises:

a spread spectrum processor counting clock periods of a reference pixel clock signal when the horizontal synchronization signal having an adjusted frame rate is activated, and sequentially outputting the plurality of oscillation signals in response to the decoding signal incrementing or decrementing in value in response to variations of the reference pixel clock signal; and a main divider generating the main divider signal by dividing the frequencies of the plurality of oscillation signals.

12. The LCD driving scaler of claim 11, wherein the spread spectrum processor comprises:

a counter being reset when the horizontal synchronization signal having an adjusted frame rate is activated, counting the number of times the reference pixel clock signal reaches a second logic level, and outputting the decoding signal that increments or decrements every predetermined number of times the reference pixel clock signal reaches the second logic level;

a decoder outputting a plurality of switching signals sequentially inverting their phases from a first logic state to a second logic state in response to the decoding signal; and a plurality of switches being activated in response to their corresponding switching signals so that one of the oscillation signals corresponding to a switch that is turned on is selectively output.

13. The LCD driving scaler of claim 10, wherein the decoding signal varies depending on the control information, and the modulation rate and the modulation frequency in a spread spectrum modulation process are determined in accordance with the variation of the decoding signal.

14. The LCD driving scaler of claim 10, wherein the horizontal synchronization signal having an adjusted frame rate is input into the counter so that it can be adjusted to be compatible with the modulation frequency in a spread spectrum modulation process.

15. The LCD driving scaler of claim 10, wherein a spread spectrum effect is obtained when the system clock signal is converted into the predivider signal through frequency modulation.

16. The LCD driving scaler of claim 10, wherein a spread spectrum effect is obtained when the input pixel clock signal is converted into the predivider signal through frequency modulation.

* * * * *